US005914565A

United States Patent [19]

Bernardini

[11] Patent Number: 5,914,565

[45] Date of Patent: Jun. 22, 1999

[54] ELECTRICAL TERMINAL BLOCK FOR HIGH WATTAGE HIGH INTENSITY LAMPS

[75] Inventor: Allen J. Bernardini, Southbury, Conn.

[73] Assignee: Litton Systems, Inc., Watertown, Conn.

[21] Appl. No.: 08/901,248

[22] Filed: Jul. 28, 1997

[51] Int. Cl.[6] ..... H01J 7/44

[52] U.S. Cl. ..... 315/56; 315/182; 439/723; 362/222

[58] Field of Search ..... 439/723, 724, 439/834; 315/182, 326, 56; 362/222; 361/640, 669

[56] References Cited

U.S. PATENT DOCUMENTS

| | | | |
|---|---|---|---|
| 2,071,948 | 2/1937 | Peters | 439/834 X |
| 4,037,912 | 7/1977 | Besser et al. | 339/198 R |
| 4,076,991 | 2/1978 | Datta | 313/220 |
| 4,229,780 | 10/1980 | Nelson | 362/218 |
| 5,540,602 | 7/1996 | Bell | 439/721 |

*Primary Examiner*—Haissa Philogene

*Attorney, Agent, or Firm*—Michael H. Wallach

[57] ABSTRACT

An electrical terminal block for a high wattage high intensity projection lamp, and use thereof. The electrical terminal block is connected to an electrical power supply and has an orifice for plug-in of cable that forms part of such a lamp. The terminal block reduces premature lamp failure.

18 Claims, 2 Drawing Sheets

ELECTRICAL TERMINAL BLOCK FOR HIGH WATTAGE HIGH INTENSITY LAMPS

FIELD OF THE INVENTION

The present invention relates to electrical terminal blocks for high wattage high intensity lamps, especially metal halide e.g. halide mercury iodide (HMI) lamps. In particular, the present invention relates to an improvement in electrical terminal blocks conventionally used with such lamps.

BACKGROUND OF THE INVENTION

High wattage high intensity lamps are used in a number of industries or activities that require a high intensity projected light. In particular, such lamps are used in high wattage theatrical and movie lamps and other high wattage lighting systems. For instance, in use as a theatrical lamp, the high intensity lamp is subjected to continuous or intermittent periods of use at full intensity and/or dimmed to the appropriate requirements of the theatrical performance. As such, in a single performance the lamp may undergo a number of heating and cooling cycles. In the movie industry, high intensity lamps tend to undergo a period of high intensity use, followed by periods of time when the lamp is not in use, e.g. until the next movie scene is to be shot. Other uses of high wattage high intensity lighting, movie and projection lamps are known.

The high wattage high intensity lamp must be connected to a power supply in a manner that will permit the changing of the lamp in the event that the bulb in the lamp burns out, referred to herein as burn out of the lamp. It is often necessary to be able to replace the high wattage high intensity lamp in a short period of time i.e. with minimal delay, so as not to unduly interrupt the shooting of a movie or the provision of appropriate lighting during a theatrical performance, or other use of the lamp. Thus, the lamp should be capable of being removed and replaced as quickly as possible.

Connection between the lamp and the source of electricity was traditionally achieved by providing cables terminating in annular connectors, also known as ring lug connectors, on both the lamp and the source of electricity i.e. the power supply. The lamp and power supply were connected by inserting a bolt through each of the annular connectors and tightening the bolt on a nut, or more commonly by screwing the bolt into a threaded orifice suitably located in the lamp system e.g. on a wall of a housing or other location. However, it was found that over a period of time, the heating and cooling of the lamp tended to loosen the bolt connection. The consequence was that the cable from the power supply tended to burn through, usually at or near the connector on that cable, and thereby disrupt the supply of electricity. This caused major problems in the use of the lighting system, and was the primary cause of the failure of the lighting system.

An improvement was made in which the cable of the power supply, also known in the industry as the ballast, was fed to and connected via a crimp joint to form a unitized assembly with a terminal block. The power supply cable was crimped into an inlet barrel that formed part of the terminal block, thereby retaining the power supply cable in the inlet of the terminal supply. Removal of the power supply cable was not intended, and the power supply cable and attached terminal block would be replaced as a unit if that should ever be necessary. The lamp was connected to the terminal block using the annular connector, which was bolted into a threaded orifice located on the terminal block.

This type of terminal block has been used with high wattage high intensity lamps for many years, and has effectively eliminated the problem of burn-through of the power supply cable. Nonetheless, a problem of premature burn-out of the high wattage high intensity lamps per se has existed, and has continued to occur from time to time. Premature burn-out is costly, as the lamps are very expensive.

SUMMARY OF THE INVENTION

An improved electrical terminal block for use with high wattage high intensity lamps has now been found.

Accordingly, an aspect of the present invention provides an electrical terminal block for use in combination with a high wattage high intensity lamp, said terminal block being adapted to be connected to an electrical cable for supply of electricity from a source thereof and having an outlet for supply of electricity to said high wattage high intensity lamp, said outlet being adapted to receive a plug-in cable connector on a cable extending from and forming part of said high wattage high intensity lamp.

In a preferred embodiment of the electrical terminal block of the invention, the electrical cable for supply of electricity is connected to and forms part of said terminal block, especially connected to the terminal block using a crimped connection e.g. by crimping the electrical supply cable into a barrel inlet forming part of the terminal block.

In another embodiment, the high wattage high intensity lamp is a metal halide lamp, especially a halide mercury iodide lamp.

Another aspect of the present invention provides use of an electrical terminal block in combination with a high wattage high intensity lamp, said terminal block being connected to an electrical cable for supply of electricity from a source thereof and having an outlet for supply of electricity to said high wattage high intensity lamp, said lamp having a plug-in cable connector on a cable extending from and forming part of said high wattage high intensity lamp, said plug-in cable connector being inserted in an outlet in said electrical terminal block.

BRIEF DESCRIPTION OF THE DRAWINGS

The present invention is illustrated by the embodiments shown in the drawings, in which.

DETAILED DESCRIPTION OF THE INVENTION

Figure 1:
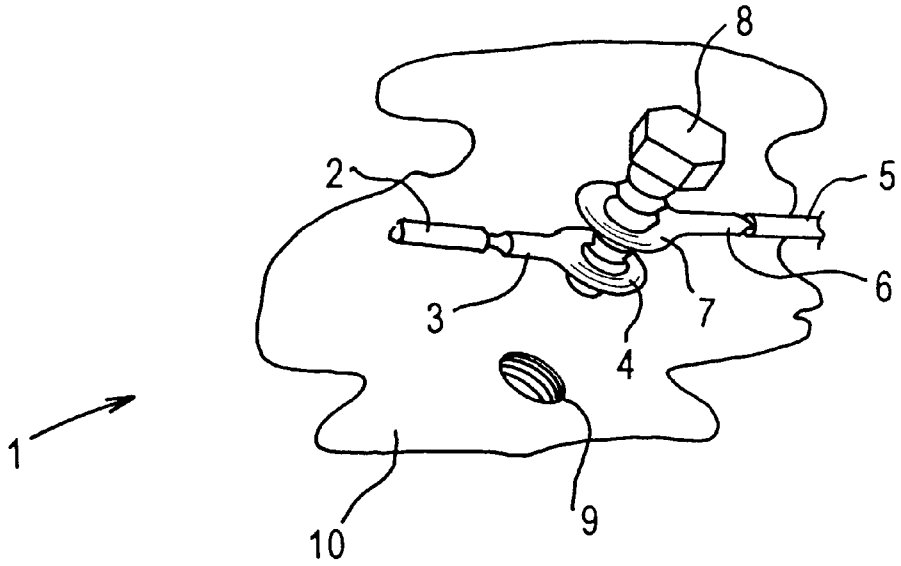
Fig. 1 (PRIOR ART)
FIG. 1 is a schematic representation of the prior art in which electrical cable and a high wattage high intensity lamp were connected together using a bolt.

FIG. 1 shows a bolt connector of the prior art generally indicated by 1. Bolt connector 1 connects power supply cable 2 to lamp cable 5. Power supply cable 2 has power supply connector 3 on the end thereof, which has annular ring 4. Lamp cable 5 has lamp connector 6 on the end thereof, which has annular ring 7. It is to be understood that lamp cable 5 extends directly from the high wattage high intensity lamp (not shown), forming part of that lamp.

Bolt 8 is shown passing through annular ring 7 of lamp cable 5 and annular ring 4 of power supply cable 2. Bolt 8 is screwed into threaded orifice 9 of housing 10 in order to connect power supply cable 2 to lamp cable 5, and retain the connection between such cables.

In operation, to replace a high wattage high intensity lamp, bolt 8 is unscrewed from threaded orifice 9 and connectors 3 and 6 are removed from bolt 8. Assuming that the lamp is to be changed, a new cable 5 from the new lamp would be located in the appropriate position and bolt 8 would be passed through annular ring 7 and annular ring 4 and threaded back into threaded orifice 9. Bolt 8 would then be tightened. The same procedure would be used if the power supply cable had to be replaced. Cable burn-out, particularly of the power supply cable, was the major and relatively frequent cause of failure.

Figure 2:
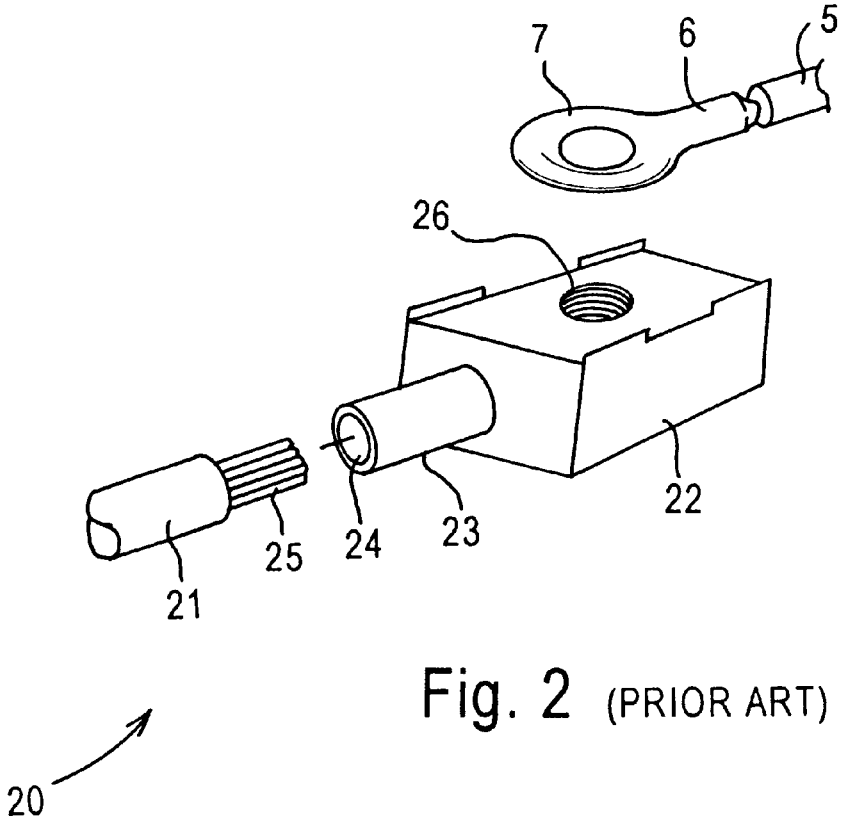
Fig. 2 (PRIOR ART)
FIG. 2 is a schematic representation of the prior art, partially in exploded view, in which a terminal block was provided with a crimped connection to the electrical cable and the annular connector of the lamp was connected by a bolt.

FIG. 2 shows a connector generally indicated by 20. Connector 20 has power supply cable 21, terminal block 22 and lamp cable 5. Power supply cable 21 has end 25 that in practice would be located in inlet orifice 24 of inlet barrel 23 of terminal block 22, and crimped into inlet barrel 23 to form part of terminal block 22. Terminal block 22 has threaded orifice 26 which serves the same purpose as threaded orifice 9 of FIG. 1.

In operation, power supply cable 21 may be exchanged for another supply cable by replacement of the cable and connected terminal block. In order to replace the lamp (not shown), a bolt (not shown) is unscrewed from threaded orifice 26 and cable 5 of the lamp is removed and replaced with the corresponding cable 5 of the new lamp. The bolt is then threaded through annular ring 7 of lamp cable 5 of the new lamp and tightened in threaded orifice 26. Inconsistent tightening of the bolt led to premature lamp failure.

Figure 3:
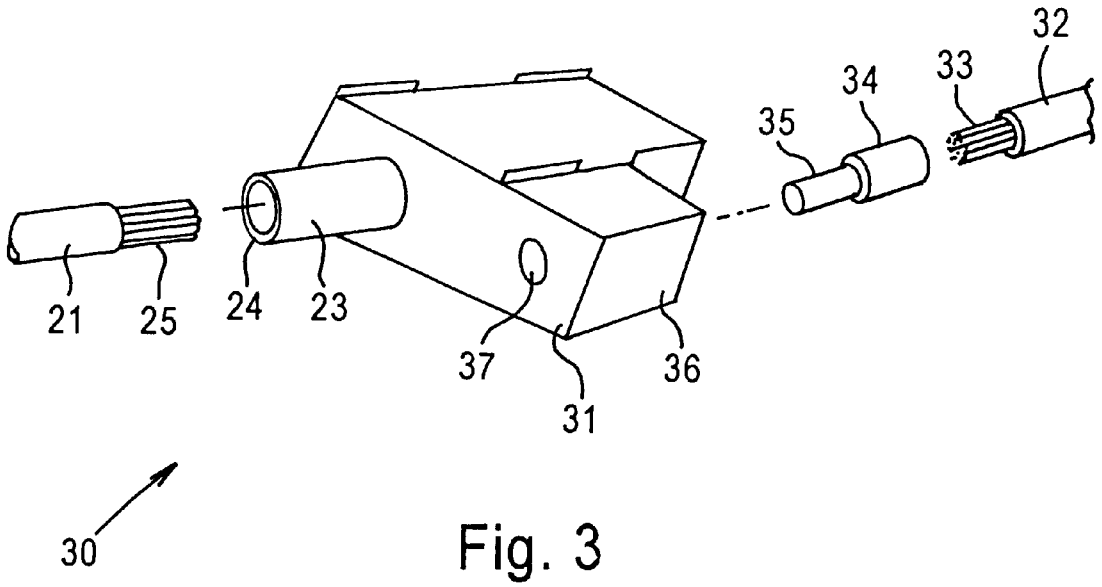
FIG. 3 is a schematic representation of an electrical terminal block of the present invention, partially in exploded view.

FIG. 3 shows a connector of the present invention, generally indicated by 30. Connector 30 has terminal block 31 that is shown as being connected to power supply cable 21 in the manner of FIG. 2. Power supply cable 21 has, in exploded view, end 25 that is to be inserted in inlet orifice 24 of inlet barrel 23, and crimped therein for retention, as described with respect to FIG. 2.

In the exploded view of the embodiment of FIG. 3, the lamp cable, 32, has end 33, which is inserted in inlet plug 34 and crimped therein to form part of lamp cable 32 of the high wattage high intensity lamp. Inlet plug 34 has inlet plug projection 35 that is intended to be inserted in a lamp cable orifice 39 (shown in FIG. 4). Orifice 37 is located in block end 36 of terminal block 31 and is optional, passing through block end 36 and is one end of lamp cable orifice 39.

In operation, a power supply cable 21 is inserted into and forms part of terminal block 31 in the same manner as described above with respect to FIG. 2. The power supply cable could be supplied with the terminal block already connected to the end of the cable. A lamp with lamp cable 32 is connected to and crimped into inlet plug 34. Inlet plug 34 is inserted in lamp cable orifice 39, by inserting inlet plug projection 35 into that orifice from the back side, as viewed, of terminal block 31.

Figure 4:
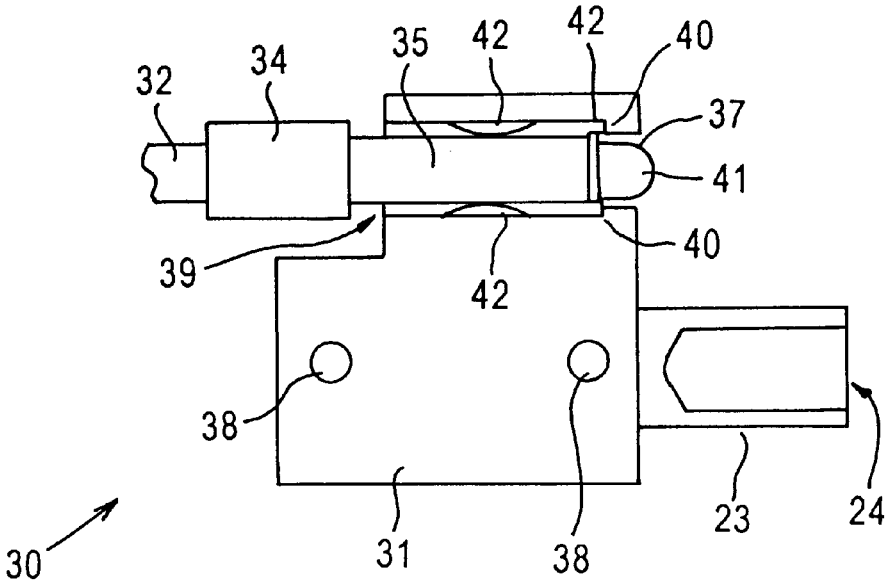
FIG. 4 is a schematic representation of a cross-section, in plan view, of a terminal block of the invention having a lamp cable plugged into the terminal block.

FIG. 4 shows terminal block 31 as having inlet barrel 23 for the electrical cable. Inlet barrel 23 has inlet orifice 24 that extends into inlet barrel 23, and into which the electrical cable is inserted and crimped in place forming a part of the power supply cable. Terminal block 31 is also shown as having two orifices 38 which extend through terminal block 31 and are intended for use with screws, or the like, to attach the terminal block to a housing or other convenient location.

In the embodiment shown, lamp cable orifice 39 is located on the side of terminal block 31 opposed to inlet 23, it being understood that it could be located elsewhere on terminal block 31. Lamp cable orifice 39 extends through terminal block 31, terminating in orifice 37. Lamp cable orifice 39 is of uniform diameter for substantially its entire length from its open end, into which the cable is inserted, to shoulder 40 located juxtaposed to lamp cable orifice 37.

An annular spring mechanism, 42, may be installed in lamp cable orifice 39 to grip male inlet projection 35. Other methods of providing electrical/mechanical contact may be used e.g. fingers or springs in orifice 39 or a split projection 35 that plugs into and is retained in orifice 39. A method of providing such electrical mechanical contact is preferably used.

Lamp cable 32 is shown as having inlet plug 34 attached thereto. Inlet plug projection 35 extends from inlet plug 34 into lamp cable orifice 39. Inlet plug projection 35 terminates in end shoulder 42 and tip 41; it is to be understood that tip 41 is optional. Tip 41, if present, extends through lamp cable orifice 37 in terminal block 31, and is removably retained therein.

In operation, electrical cable of the power supply is provided, already attached to a terminal block. Lamp cable 32 is inserted in lamp cable orifice 39, being urged into lamp cable orifice 39 until end shoulder 42 of the inlet plug projection is fully inserted, normally abutting shoulder 40 of terminal block 31. This could cause tip 41, if present, to extend through orifice 37. To remove lamp cable 32, inlet plug 34 would be pulled from lamp cable orifice 39.

The terminal block of the present invention overcomes, or reduces the tendency of, premature lamp failure resulting from the connection of the cable from the lamp to a terminal block using the traditional annular or ring lug connectors. It is understood that the terminal block of the present invention requires a modification in the lamps normally commercially available as high wattage high intensity lamps, by replacement of the annular cable connection with a plug-in cable end, but a more consistent and predictable lamp life is achieved. Significant benefits result.

I claim:

1. An electrical terminal block for use in combination with a high wattage high intensity lamp, said terminal block being adapted to be connected to an electrical cable for supply of electricity from a source thereof and having an outlet for supply of electricity to said high wattage high intensity lamp, said outlet being adapted to receive a plug-in cable connector on a cable extending from and forming part of said high wattage high intensity lamp, wherein said outlet defines a bore having an annular spring mechanism positioned therein and said plug-in cable connector has a circular outer diameter.

2. The electrical terminal block of claim 1 in which electrical cable for supply of electricity is connected to and forms part of said terminal block.

3. The electrical terminal block of claim 2 in which the electrical cable for supply of electricity is connected to the terminal block using a crimped connection.

4. The electrical terminal block of claim 3 in which the electrical supply cable is connected to the terminal block by crimping said electrical supply cable into a barrel inlet forming part of the terminal block.

5. The electrical terminal block of claim 4 in which said high wattage high intensity lamp is a metal halide lamp.

6. The electrical terminal block of claim 4 in which said lamp is a halide mercury iodide lamp.

7. The electrical terminal block of claim 1, wherein said bore is a through bore.

8. The electrical terminal block of claim 7, wherein said through bore has a step defining a larger diameter bore and a smaller diameter bore.

9. The electrical terminal block of claim 8, wherein said plug-in cable connector has a larger diameter portion and a smaller diameter portion, said larger diameter portion being retained when said plug-in connector engages said annular spring mechanism.

10. Use of an electrical terminal block in combination with a high wattage high intensity lamp, said terminal block being connected to an electrical cable for supply of electricity from a source thereof and having an outlet for supply of electricity to said high wattage high intensity lamp, said lamp having a plug-in cable connector on a cable extending from and forming part of said high wattage high intensity lamp, said plug-in cable connector being inserted in an outlet in said electrical terminal block, wherein said outlet defines a bore having an annular spring mechanism positioned therein and said plug-in cable connector has a circular outer diameter.

11. The use of claim 10 in which electrical cable for supply of electricity is connected to and forms part of said terminal block.

12. The use of claim 11 in which said high wattage high intensity lamp is a metal halide lamp.

13. The use of claim 11 in which said lamp is a halide mercury iodide lamp.

14. The use of claim 13 in which the plug-in cable connector is a plug-in crimped cable connector attached to and forming part of said lamp.

15. The use of claim 14 in which the electrical supply cable is connected to the terminal block by crimping said electrical supply cable into a barrel inlet forming part of the terminal block.

16. The use of claim 10, wherein said bore is a through bore.

17. The use of claim 16, wherein said through bore has a step defining a larger diameter bore and a smaller diameter bore.

18. The use of claim 17, wherein said plug-in cable connector has a larger diameter portion and a smaller diameter portion, said larger diameter portion being retained when said plug-in connector engages said annular spring mechanism.

* * * * *